US007219795B2

(12) United States Patent
Poux

(10) Patent No.: US 7,219,795 B2
(45) Date of Patent: May 22, 2007

(54) DEVICE FOR PROTECTING A PAINTER'S CANVAS IN PARTICULAR DURING ITS TRANSPORT

(76) Inventor: Herve Poux, Le Presbytere, Noailles (FR) F-81170

( * ) Notice: Subject to any disclaimer, the term of this patent is extended or adjusted under 35 U.S.C. 154(b) by 0 days.

(21) Appl. No.: 10/312,145

(22) PCT Filed: Jun. 18, 2001

(86) PCT No.: PCT/FR01/01893

§ 371 (c)(1),
(2), (4) Date: Dec. 23, 2002

(87) PCT Pub. No.: WO01/98093

PCT Pub. Date: Dec. 27, 2001

(65) Prior Publication Data

US 2003/0094825 A1 May 22, 2003

(30) Foreign Application Priority Data

Jun. 22, 2000 (FR) ..... 00 08031

(51) Int. Cl.
*B44D 7/00* (2006.01)

(52) U.S. Cl. ..... 206/1.7; 206/521; 206/590; 206/592

(58) Field of Classification Search ..... 206/1.7, 206/583, 592, 593, 594, 565, 451, 1.8, 1.9, 206/449, 590; D9/425, 428, 456; 224/678, 224/324, 328; 220/571, 573; 184/106
See application file for complete search history.

(56) References Cited

U.S. PATENT DOCUMENTS

| | | | | |
|---|---|---|---|---|
| 2,895,599 | A * | 7/1959 | Moyer et al. | 206/454 |
| 3,171,347 | A * | 3/1965 | Elrod | 100/1 |
| 3,491,681 | A * | 1/1970 | Quinlan et al. | 100/34 |
| 3,655,034 | A * | 4/1972 | Stollman et al. | 206/454 |
| 4,606,140 | A | 8/1986 | Mitchell et al. | |
| 4,664,254 | A * | 5/1987 | Sitwell et al. | 206/1.7 |
| D307,716 | S * | 5/1990 | Fitzloff et al. | D9/424 |
| 4,995,525 | A * | 2/1991 | Kehrer | 220/694 |
| 5,259,523 | A * | 11/1993 | Scherb | 220/4.26 |
| 5,326,147 | A | 7/1994 | Watson | |
| 5,404,848 | A * | 4/1995 | Nelson | 123/198 E |
| 5,518,118 | A * | 5/1996 | Putz et al. | 206/449 |
| 5,526,900 | A * | 6/1996 | Mason | 184/106 |
| 5,529,184 | A * | 6/1996 | Sadow | 206/320 |
| 5,595,301 | A * | 1/1997 | Putz et al. | 206/449 |
| 5,603,558 | A * | 2/1997 | Zimmer | 312/290 |
| 5,934,472 | A * | 8/1999 | Ramirez et al. | 206/557 |
| 6,232,585 | B1 * | 5/2001 | Clothier et al. | 219/620 |

FOREIGN PATENT DOCUMENTS

| | | |
|---|---|---|
| DE | 8904037 | 12/1989 |
| FR | 2 781 422 | 1/2000 |

* cited by examiner

*Primary Examiner*—David T. Fidei
(74) *Attorney, Agent, or Firm*—Young & Thompson

(57) ABSTRACT

A device in the form of a concave receptacle (2) has a base (10) from which extends gradually flaring out, at least locally, an edge (12), the painted surface of the canvas (18) being designed to be urged facing the base (10), without touching it and the corners of the canvas being urged in contact locally with the edge (12).

5 Claims, 2 Drawing Sheets

DEVICE FOR PROTECTING A PAINTER'S CANVAS IN PARTICULAR DURING ITS TRANSPORT

BRIEF DESCRIPTION OF THE INVENTION

The present invention relates to a device for protecting an artist's canvas, in particular during transportation.

A device of this kind is used to transport and protect a canvas mounted on a stretcher whether the paint is wet or dry.

DESCRIPTION OF THE RELATED ART

Painters often use systems that they have designed for themselves. Accordingly, to transport two canvases, the canvases can be placed face-to-face and held apart by four cork disks placed at the four corners of the canvases. This system is somewhat impractical, relatively unreliable, and has the drawback of having to transport, and possibly soil, two canvases without them being totally safe.

There also exist devices including a plank providing with clamps intended to retain the canvas mounted on its stretcher. The document U.S. Pat. No. 5,326,147 discloses a device of this kind, for example. Each time that a canvas is to be placed in the device, or removed from it, adjustments are necessary. Only one canvas is necessary, but a device of this kind is somewhat impractical and transport is not very safe. The documents FR.2 781 422 and DE-U-89040387 disclose devices for protecting a canvas. These are also somewhat impractical because of the adjustments needed to place a canvas therein and the protection provided is not always very effective.

SUMMARY OF THE INVENTION

Thus an object of the present invention is to provide a practical device for protecting an artist's canvas, which preferably provides effective protection, and is advantageously of small overall size to facilitate transporting the protected canvas.

To this end, it proposes a device for protecting an artist's canvas, in particular while transporting it, characterized in that it takes the form of a concave receptacle having a bottom from which extends a rim that progressively widens, at least locally, the painted face of the canvas being intended to face the bottom without touching it and the corners of the canvas coming into local contact with the rim.

To protect a canvas, it is sufficient to place it in the device with the front facing the bottom. The corners of the canvas come into contact with the rim and the painted face is automatically held away from the bottom of the device. The bottom then covers the painted canvas entirely, without touching it, providing perfect protection.

In a preferred embodiment, the bottom of the device is flat. It is advantageously smaller than the canvases intended to be placed in the device. The bottom is substantially rectangular, for example.

In one embodiment, the rim has a substantially elliptical cross section, for example.

The rim preferably surrounds the whole of the periphery of the bottom in order to provide better protection of the transported canvas and can also have two facing notches on its free edge. The canvas can be secured perfectly by passing straps through the notches. The straps are not obligatory if the device is laid flat with the canvas substantially horizontal, for example if the device is placed flat in the boot of a vehicle.

In a preferred embodiment, the bottom of the device is plane and substantially rectangular and the rim includes four notches, one on each side of the device. In this embodiment, the shape of the device is perfectly adapted to a canvas and two straps provide excellent retention of the canvas in the device.

A device as described hereinabove can be injection molded from a synthetic material, for example.

As already indicated, the device can also include means for retaining the canvas, for example a set of straps. Straps have the advantage of being easy to transport, easy to fit and compact and guarantee perfect retention of a canvas in the receptacle.

BRIEF DESCRIPTION OF THE DRAWINGS

Details and advantages of the device according to the invention will emerge better from the following description with reference to the accompanying diagrammatic drawings, in which.

DESCRIPTION OF THE PREFERRED EMBODIMENTS

Figure 1:
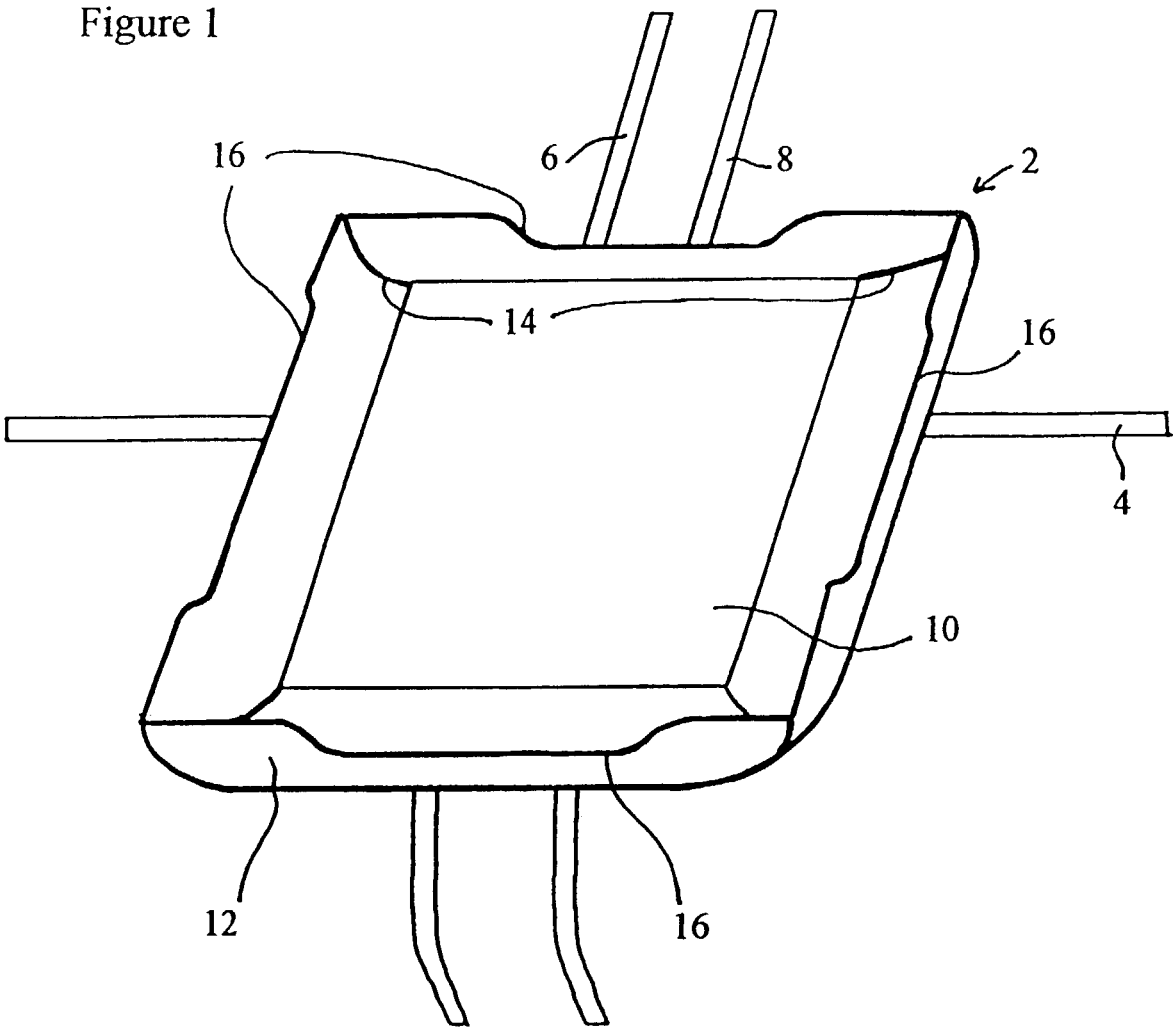
FIG. 1 is a perspective view of a device according to the invention.

The device for protecting an artist's canvas shown in the drawings includes a shell 2 and straps 4, 6 and 8.

The shell 2 is injection molded from a synthetic material, for example, and has a flat bottom 10 at the periphery of which is a rim 12.

Figure 2:
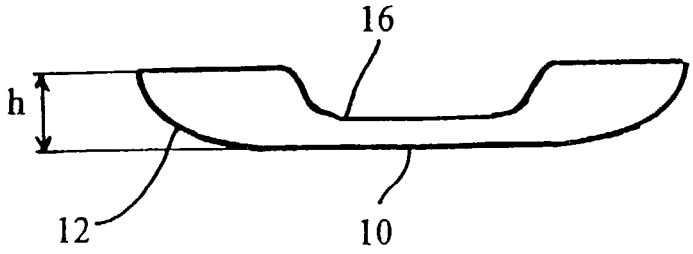
FIG. 2 is a side view of the device from FIG. 1 to a smaller scale.

The flat bottom 10 is substantially rectangular. The rim 12 extends all around the periphery of the bottom 10 and is joined to the flat bottom 10 and extends it continuously, rising and widening progressively. A rim from 50 mm to 100 mm high is obtained in this way, for example. This height corresponds to the dimension h in FIG. 2. The shell 2 as a whole has a width from 200 mm to 1000 mm and a length from 300 mm to 1300 mm, for example. Other heights, widths and lengths can be adopted in particular instances, of course. The dimensions specified by way of illustrative example produce a shell able to protect the sizes of canvas most frequently used.

The rim 12 rises, for example, so that when the device is seen in cross section the rim is elliptical, for example a quarter-ellipse joined onto the bottom 10. Thus in side view (FIG. 2) the flat bottom 10 is seen as a straight line to which a quarter-ellipse is joined at each end. A different shape could be adopted, of course. For example, there could simply be a rim forming an inclined plane on each side of the bottom 10. The shell 2 would then be hopper-shaped.

There is an edge 14 at each corner of the flat bottom 10. Thus the rim 12 is divided into four sides separated from each other by the edges 14.

Each side of the rim 12 has a notch 16 in its free edge, i.e. the edge opposite the flat bottom 10. The notches are for the straps 4, 6 and 8 for retaining a canvas 18 mounted on a stretcher, as shown in FIGS. 3 and 4.

Figure 3:
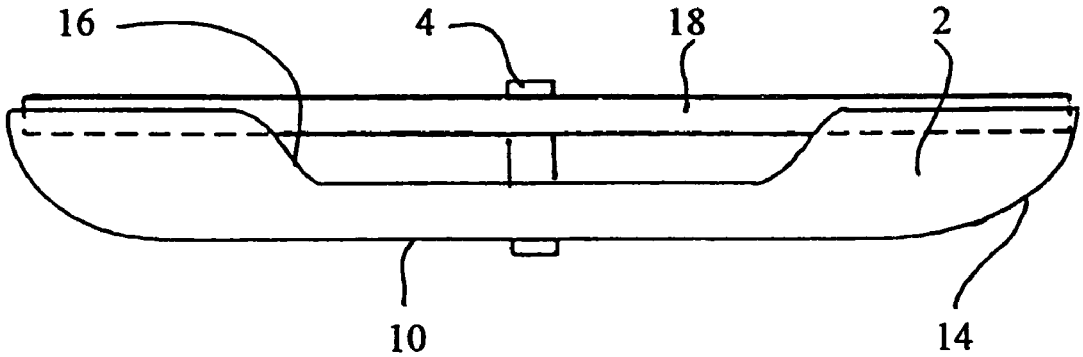
FIG. 3 is a view corresponding to FIG. 2 to a larger scale, with a canvas on a stretcher placed in the protection device according to the invention, and FIG. 4 corresponds to the FIG. 3 view with a smaller canvas.

FIG. 3 shows a canvas 18 mounted on a stretcher placed in the device from FIG. 1. The painted face of the canvas 18 faces toward the flat bottom 10. The canvas 18 is conventionally rectangular. When the canvas is placed in the shell 2, its four corners rest on an edge 14, as shown in FIG. 3. FIG. 3 shows only the strap 4 for retaining the canvas 18 in the shell 2 and that the strap 4 passes through two of the notches 16 in the rim 12 of the shell 2.

Figure 4:
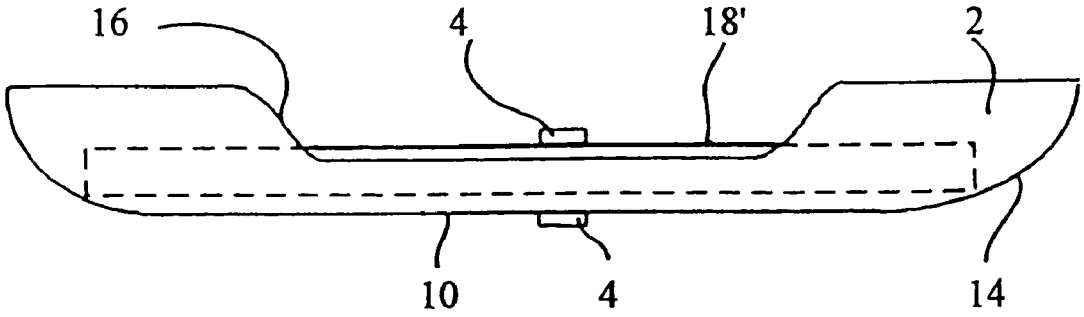

FIG. 4 shows a smaller canvas 18' placed in the same shell 2. Once again, the strap 4 passing through two opposite notches 16 retains the canvas 18'.

The same shell can therefore receive canvases not only of different sizes but also of different shapes. Canvases suitable for the same shell must be larger than the flat bottom 10 and smaller than the rim 12 at its free edge.

The protection device described above does not necessitate any adjustments and provides excellent protection of an artist's canvas, whether the paint is already dry or still wet. The device proves to be very easy to use. It can protect and transport canvases of different sizes and is relatively compact.

A range of different size shells can be produced to cover all sizes of canvas conventionally used. A range of shells provides every time a shell whose height is not too great and whose size is in proportion to the size of the canvas to be protected.

Of course, the present invention is not limited to the preferred embodiment described above. It also encompasses all embodiments that will suggest themselves to the person skilled in the art that fall within the scope of the following claims.

Thus the straps are optional, for example. Other retaining systems can be envisaged. For example, a canvas placed in a shell can be put into a suitable size bag or envelope, which would then retain the canvas. A canvas can simply be placed in the corresponding shell to transport it flat, for example on the floor of the boot of a vehicle. Being flat throughout the journey, the canvas will remain well protected without needing a retaining device. The shape of the shell can vary. It is important that the bottom and the rim form a globally concave combination. A bottom resembling a waffle can be used, for example, without departing from the scope of the invention.

The edges on the rim are optional. The rim can have rounded corners.

Similarly, the rim does not necessarily extend all around the flat bottom. This provides better protection of the canvas, but protection is nevertheless provided if the rim is limited to four curved corners each receiving one corner of a canvas, which in fact amounts to providing very wide notches.

The invention claimed is:

1. The combination of an artist's canvas and a protective device, the canvas having a painted face and corners, the protective device having the form of a concave receptacle and the canvas being received in the protective device with its painted face facing a central portion of the receptacle without touching said central portion and with its corners coming into local contact with the receptacle, wherein said concave receptacle has four curved corners each receiving one corner of a canvas.

2. The combination of claim 1, further comprising retaining means for retaining the canvas in position within the concave receptacle.

3. The combination of claim 2, wherein the retaining means are retaining straps.

4. The combination of claim 2, wherein the concave receptacle has a periphery with notches receiving retaining straps.

5. The combination of claim 1, wherein the receptacle is from 50 mm to 100 mm high and has a width from 200 mm to 1000 mm and a length from 300 mm to 1300 mm.

* * * * *